US011154104B2

(12) United States Patent
Liran

(10) Patent No.: US 11,154,104 B2
(45) Date of Patent: Oct. 26, 2021

(54) STRUCTURALLY STABLE QUILTED STRETCHABLE FABRIC AND METHODS OF PREPARATION THEREOF

(71) Applicant: Giora Liran, Nashua, NH (US)

(72) Inventor: Giora Liran, Nashua, NH (US)

(73) Assignee: YOGIBO LLC, Nashua, NH (US)

( * ) Notice: Subject to any disclaimer, the term of this patent is extended or adjusted under 35 U.S.C. 154(b) by 292 days.

(21) Appl. No.: 15/079,022

(22) Filed: Mar. 23, 2016

(65) Prior Publication Data

US 2016/0281279 A1 Sep. 29, 2016

Related U.S. Application Data

(60) Provisional application No. 62/137,212, filed on Mar. 23, 2015.

(51) Int. Cl.

| | |
|---|---|
| ***A41D 31/02*** | (2019.01) |
| ***D04B 1/18*** | (2006.01) |
| *A47G 9/08* | (2006.01) |
| *A47G 9/02* | (2006.01) |
| *A47G 9/10* | (2006.01) |

(52) U.S. Cl.

CPC ..... *A41D 31/02* (2013.01); *D04B 1/18* (2013.01); *A47G 9/0223* (2013.01); *A47G 9/0253* (2013.01); *A47G 9/08* (2013.01); *A47G 9/10* (2013.01)

(58) Field of Classification Search

CPC ..... A41D 31/0011; A41D 31/02; D04B 1/18; A47G 9/10; A47G 9/0223; A47G 9/08; A47G 9/0253

See application file for complete search history.

(56) References Cited

U.S. PATENT DOCUMENTS

| | | | | |
|---|---|---|---|---|
| 5,014,636 A * | 5/1991 | Seber | A41D 13/0012 | 112/419 |
| 5,437,239 A * | 8/1995 | Blake | A41D 31/02 | 112/475.22 |
| 2004/0068795 A1* | 4/2004 | Hollander | A47G 9/0207 | 5/502 |
| 2006/0021387 A1* | 2/2006 | Chuang | D04B 1/18 | 66/8 |
| 2012/0260422 A1* | 10/2012 | Rock | A41D 31/0038 | 5/483 |

* cited by examiner

*Primary Examiner* — Brian Handville

(74) *Attorney, Agent, or Firm* — JWIP & Patent Services, LLC; Jacob G. Weintraub, Esq.

(57) ABSTRACT

The present invention provides a novel and inventive quilted stretchable fabric (QSF) provided by the combination of specific elements as described herein, which provides a structurally stable yet stretchable quilted fabric. In particular, the present invention is directed to a quilted stretchable fabric (QSF) comprising a layered combination of stretchy fabric material and stretch-resistant fabric material, and the methods of preparation thereof, which remains securely associated by stitching even when subject to the repeated strain and forces of use, e.g., stretching, pulling, and the like. Further, articles of manufacture comprising this novel and inventive fabric are also provided herein.

24 Claims, 5 Drawing Sheets

(a)

(b)

Loop diagram of Single jersey:

Technical Face:

Technical Back:

Technical back

Technical Face

STRUCTURALLY STABLE QUILTED STRETCHABLE FABRIC AND METHODS OF PREPARATION THEREOF

RELATED APPLICATIONS

This application claims the benefit of priority from U.S. Provisional Patent Application No. 62/137,212, filed on Mar. 23, 2015, the entirety of which is incorporated herein by reference.

BACKGROUND OF THE INVENTION

Knitted fabric is a mainstay in the manufacture of numerous items, from clothing to toys to blankets. Knitted fabric is popular for these types of items because of its ability to be repeatedly stretched and returned to its original or near original shape and state. However, the very feature that makes knitted fabric popular makes manipulating this fabric difficult during the assembly of quilted goods such as clothes, furniture, coverings, or blankets; and even more so when knitted with elastic threads, i.e., spandex and similar.

Although it is quite desirable to produce items that utilize the stretch feature of a knitted fabric, unfortunately the manufacture and use of items is limited by the structural stability of the stitching that secures the stretchable fabric; made more difficult by the potential inherent and opposing properties of the two materials. In this way, over time, items made of knitted fabric and secured with stitching tend to show structural instability as loosened and/or broken stitching.

In general, the current manufacturing means of attempting to overcome this structural instability has been to add complex processing of the material and more rigorous methods of assembly, including, for example, preventing the fabric from stretching during cutting, sewing and assembly. In addition, items manufactured with stretch knitted fabric may be sewn using special stretch sewing stitches that requires many more yards of thread along with more time on the sewing machine per item than conventional methods (such as straight stitching), sewn on special sewing machines, and/or sewn using more expensive elastic thread so that both the fabric and the stitching are stretchable. Moreover, in many cases, the design of the item is forced to change to accommodate these special efforts, obstructing the look of the final product.

As such, there is a need for structurally stable quilted fabrics that overcome these problem, and novel methods for preparing these fabrics.

SUMMARY OF THE INVENTION

The present invention provides a novel and inventive quilted stretchable fabric (QSF) provided by the combination of specific elements as described herein, which provides a structurally stable yet stretchable quilted fabric. In particular, the present invention is directed to a quilted stretchable fabric (QSF) comprising a layered combination of stretchy fabric material and stretch-resistant fabric material, and the methods of preparation thereof, which remains securely associated by stitching even when subject to the repeated strain and forces of use, e.g., stretching, pulling, and the like. Further, articles of manufacture comprising this novel and inventive fabric are also provided herein.

Accordingly, one aspect of the present invention provides a structurally stable quilted stretchable fabric (QSF). The QSF comprises an outer fabric layer comprising a stretchy fabric material; and an inner fabric layer comprising a stretch-resistant fabric material, wherein the outer and inner fabric layers are securely associated by stitching to produce the QSF, and wherein the outer and inner fabric layers remain securely associated upon strain applied to the stitching.

Another aspect of the present invention provides an article of manufacture comprising a structurally stable quilted stretchable fabric (QSF) of the present invention.

An additional aspect of the present invention is a blanket comprising a structurally stable quilted stretchable fabric (QSF) of the present invention.

In yet another aspect, the present invention provides a method of preparing a structurally stable quilted stretchable fabric (QSF) of the present invention. The method comprises securely associating an outer fabric layer comprising a stretchy fabric material and an inner fabric layer comprising a stretch-resistant fabric material by stitching, to produce the structurally stable, quilted stretchable fabric (QSF), wherein the outer and inner fabric layers remain securely associated upon strain applied to the stitching.

BRIEF DESCRIPTION OF THE FIGURES

Advantages of the present apparatus will be apparent from the following detailed description, which description should be considered in combination with the accompanying drawings, which are not intended limit the scope of the invention in any way.

DETAILED DESCRIPTION OF THE INVENTION

Figure 1:
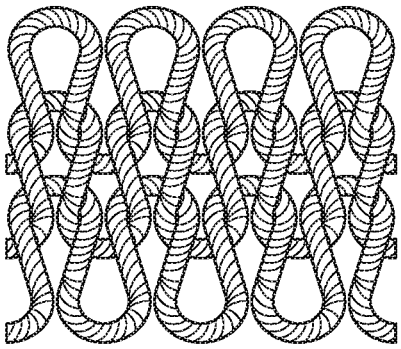
FIG. 1 provides schematic images that depict the technical face and technical back of a single jersey fabric identified by having whales in the direction of the knitting of the fabric on the technical face versus floating waves going sideways connecting the whales on the face side.
Figure 1:
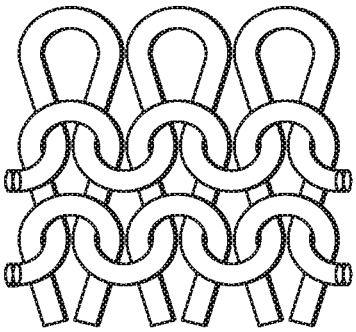

The present invention provides a novel and inventive quilted stretchable fabric (QSF) provided by the combination of specific elements that provides a structurally stable yet stretchable quilted fabric. In particular, the present invention is directed to a quilted stretchable fabric (QSF) comprising a layered combination of stretchy fabric material and stretch-resistant fabric material, and the methods of preparation thereof, which remains securely associated by stitching even when subject to the repeated strain and forces of use, e.g., stretching, pulling, and the like. Further, articles of manufacture comprising this novel and inventive fabric are also provided herein.

The QSF of the present invention afford increased structural stability as compared with stretchable fabrics previously known that do not possess the inventive combinations of the present invention. Moreover, it is the combination of the stretchy materials utilized in the outer shell layer with the stretch-resistant inner fabric layer inner layer that afford the increased structural stability of the QSF of the present invention.

The present invention, including fabric, articles of manufacture, and methods of preparation thereof, will be described with reference to the following definitions that, for convenience, are set forth below. Unless otherwise specified, the below terms used herein are defined as follows:

1. Definitions

As used herein, the term "a," "an," "the" and similar terms used in the context of the present invention (especially in the context of the claims) are to be construed to cover both the singular and plural unless otherwise indicated herein or clearly contradicted by the context.

The language "artificial silk" as used herein describes any synthetic fabric which resembles silk in having a good drape, luster and a soft hand. In certain embodiments, artificial silk is manufactured by weaving thin synthetic threads, such as polyester or rayon threads, and is thus less costly to produce than natural silk fabric. In particular embodiments, artificial silk fabric glides freely against itself and against many other types of fabric such as wool, cotton or other synthetic fabrics.

The language "batting" as used herein describes a sheet or layer of cotton, wool or synthetic fibrous material often used as layer, or even as a stuffing. Batting may comprise natural fibers such as raw cotton or wool, or synthetic fibers, for example, polyester, or any combination thereof. Batting does not have a grain or bias. Batting is often described in terms of quilting inches, a term which describes the maximum distance between ties or stitching which will prevent shifting of the batting in the quilted fabric.

The language "bias" as used herein describes the direction of a woven fabric that is at 45 degrees to the warp and weft threads of the fabric.

The language "consisting," for example, in the expression "consisting of," is used herein to provide a composition that is limited by the contents described, and is not an open term; in contrast to the use of the term "comprising," which is used herein to represent an open inclusive group. However, the language "selected from the group consisting of" is given its standard open inclusive meaning as understood by US patent law.

The language "grain" as used herein is described in reference to the warp and weft threads of a woven fabric. "With the grain" is a phrase art-recognized to describe the directions of a fabric parallel to the warp or weft threads. Lengthwise grain refers to the direction of the fabric parallel to the warp threads and crosswise grain refers to the direction of the fabric parallel to the weft threads.

The language "multi-axial response" as used herein describes the feature and property of a fabric to respond to a strain or force of use in a three-dimensional fashion, i.e., a multi-axial strain. For example, a stretchy fabric, e.g., a knitted fabric, exhibits a multi-axial response, enlarging, distending and extending in width and/or length along all axes and in any direction as needed to accommodate an external force, such as pulling, pushing against, twisting, wrenching and the like. A stretchable fabric also exhibits a multi-axial response, enlarging, distending and extending in width and/or length along all axes and in any direction as needed to accommodate an external force, such as pulling, pushing against, twisting, wrenching and the like.

The term "stitch," as used herein, describes the use of a needle and thread or yarn to join two or more layers of fabric material, e.g., to prepare a quilted fabric.

The language "securely associated" as used herein describes the proximal and physical relationship of two or more layers of fabric that are stitched together and the ability of the stitching to remain intact said layers firmly associated (e.g., as associated as the in the originally prepared material), when subject to strain, e.g., repeated strain, such as pulling, twisting, wrenching, and the like.

The language "structurally stable" as used herein describes the durability of the structure of an item in use as defined by the length of the item's life, wherein the structure of the item does not degrade in quality over a long period of use (e.g., a year), e.g., degradation showing as loosened and/or broken stitching. For example, the increased structurally stability of the QSF of the present invention results from the combination of the specific materials selected for the outer and the inner layers, as described herein.

The language "strain" as used herein describes any force applied to a fabric, such as quilted fabric, or applied to the stitching of a quilted fabric, or both. For example, strain may be caused by pushing, pulling, carrying, or applying torsional force to (e.g., twisting or wrenching) a fabric, e.g., a quilted fabric, straining the fabric and/or the stitching used to join the layers of fabric material, or both. Such strain, which may be along one or more axes, may be referred to herein as multi-axial strain.

The language "stretchable" as used herein describes the feature and property of a layered fabric material, that, when subjected to a force, can be enlarged, distended, extended in width, and/or extended in length to some degree without damaging the layered fabric material and allowing the material to bounce or return back to original state.

The language "stretch-resistant" as used herein describes the inelastic property of a fabric material, e.g., a woven fabric material or a non-woven non-knitted fabric. A stretch-resistant fabric material, when pulled between two points, for example, along the lengthwise or crosswise grain of the fabric, allows minimal or no stretching of the fabric; the threads constructing the fabric are prevented from being pulled or stretched, e.g., without damaging the fabric material. Silk or artificial silk fabric are examples of a stretch-resistant fabric.

The language "stretchy" as used herein describes the elastic properties of a fabric material when pulled between two points to the extent that the fabric material will allow the threads constructing the material to be pulled without damaging the material and allowing the material to bounce or return back to original state.

The language "suitable quilting pattern" as used herein describes any pattern or arrangement of stitches that are used to join together two or more layers of fabric material, e.g., through stitching. A suitable quilting pattern may comprise linear or non-linear lines of stitching. Suitable quilting patterns that are linear may comprise parallel and/or intersecting lines of stitching, and the intersecting stitching may intersect at any angle. Non-linear suitable quilting patterns may comprise wavy, convoluted, circular, oval, squiggly or other shapes of stitching which may or may not intersect, and intersecting stitching may intersect at any angle. A suitable quilting pattern may also be achieved by joining the layers of fabric material by tying. A suitable quilting pattern may include linear, non-linear or tie stitching or any combination thereof. A suitable quilting pattern may or may not align with either or both of the lengthwise or crosswise grain of a woven fabric, e.g., a stretch-resistant fabric. In a quilted fabric comprising a layer of batting material, a suitable quilting pattern further comprises any pattern or arrangement of stitches in which the distance between lines of stitching and/or tied stitching is appropriate for the type of batting material.

The language "treated to functionalize" as used herein describes a certain process of finishing of the fabric material by treatment to provide additional function to the fabric material through chemical treatment, such as a flame retardant, an antimicrobial agent, an anti-molding agent, an anti-static charge agent, a mosquito repellant, Scotch Guard, a softener, and a UV resistance agent II. Structurally Stable Quilted Stretchable Fabric of the Invention One embodiment of the present invention is a structurally stable quilted stretchable fabric (QSF) comprising:

an outer fabric layer comprising a stretchy fabric material; and an inner fabric layer comprising a stretch-resistant fabric material, wherein the outer and inner fabric layers are securely associated by stitching to produce the QSF, and wherein the outer and inner fabric layers remain securely associated upon strain applied to the stitching, e.g., repeated strain (e.g., multi-axial strain).

In certain embodiments of the present invention, the stretch-resistant fabric material is selected to glide freely against the stretchy fabric material (e.g., to provide a comfortable tactile feel to the QSF by a user). In particular, and without intending to be bound by theory, the reduced interaction or "freedom" of movement of the stretchy fabric material against the stretch-resistant fabric material provides the user of a fabric, or article made thereof, a unique comfortable feel based on the increased fluidity of the stretching motions of the material.

In certain embodiments of the QSF of the present invention, the inner and outer fabric material layers are securely associated by stitching thread or yarn, e.g., thread.

In certain embodiments of the QSF of the present invention the outer and inner fabrics are essentially the same shape and size.

In certain embodiments of the QSF of the present invention, the QSF may comprise additional inner fabric layers of stretch-resistant fabric material, e.g., further comprising a second inner fabric layer comprising a stretch-resistant fabric material.

In certain embodiments of the QSF of the present invention comprising additional fabric layers, the QSF may further comprise a central core material layer positioned between two inner fabric layers, e.g., between the first and second inner fabric layers.

In certain embodiments of the QSF of the present invention, the layers are positionally matched and securely associated by stitching along the entire length of all edges. In particular embodiments, the positionally matched layers are further securely associated by a suitable quilting pattern, wherein the suitable quilting pattern is stitched in partial or full parallel alignment with the crosswise or lengthwise grain of the stretch-resistant fabric. In specific embodiments, the suitable quilting pattern is stitched in full parallel alignment with the crosswise and lengthwise grain of the stretch-resistant fabric. In certain embodiments, the suitable quilting pattern is appropriate for the type of batting material. In certain embodiments, the stitches of the suitable quilting pattern are greater than 5 inches apart, e.g., greater than 6 inches apart, e.g., greater than 7 inches apart, e.g., greater than 8 inches apart, e.g., greater than 9 inches apart, e.g., greater than 10 inches apart, e.g., greater than 11 inches apart, e.g., greater than 12 inches apart. In certain embodiments, the stitches of the suitable quilting pattern are 10 inches apart.

In certain embodiments of the QSF of the present invention, the QSF may be modified/treated/functionalized, and is resistant to degradation, destruction, damage, or compromise by one or more environmental conditions or elements that would otherwise degrade, destroy, damage or compromise an unmodified QSF under such conditions. In particular embodiments, the QSF is resistant (i.e., completely or partially) to degradation, destruction, damage, or compromise from environmental conditions or elements selected from the group consisting of moisture, UV, pet damage, temperature, or any combination thereof.

Another embodiment of the present invention provides an article of manufacture comprising a structurally stable quilted stretchable fabric (QSF) of the present invention. In certain embodiments, the article of manufacture is selected from the group consisting of a blanket, a toy, a pillow, a pillow cover, a furniture cover, an article of clothing, a sleeping bag, and a fabric (e.g., an insulating fabric or an industrial use fabric).

In an additional embodiment, the present invention provides a blanket comprising a structurally stable quilted stretchable fabric (QSF) of the present invention.

In one embodiment, the present invention provides a blanket comprising a structurally stable quilted stretchable fabric (QSF) comprising:

an outer fabric layer comprising a stretchy circular knitted fabric, e.g., comprising a yarn mix ratio of cotton yarn and spandex yarn (e.g., 94% cotton yarn and 6% spandex yarn, e.g., Lycra Spandex yarn);

one or two inner fabric layers comprising a stretch-resistant artificial silk;

a central core layer, e.g., comprising fiber batting (e.g., batting of synthetic fiber, natural fiber, or any mix of fibers at any ratio and any density and fineness); and a binding strip comprising the stretchy circular knitted fabric of the outer fabric layer, wherein the outer fabric layer, the inner fabric layer, and the central core layer are essentially the same shape and size, and are securely associated by stitching along the entire length of all edges, and further comprising a suitable grid-shaped quilting pattern (e.g., 10 inches apart) to produce the QSF, and wherein the outer and inner fabric layers remain securely associated upon strain applied to the stitching. The blanket may be any shape. In a particular embodiment, the blanket dimensions are 150 cm×170 cm. In another particular embodiment, the blanket dimensions are 170 cm×220 cm.

A. Outer Fabric Layer

The QSF of the present invention comprise a stretchy outer layer, e.g., engineered to be stretchy (e.g., comprising one or more fibers). The stretchy outer layer defines the outer shell that serves as the outer layer of the QSF (i.e., the surrounding layer presenting on the exterior of the material)

and encloses most (e.g., greater than 95%, e.g., 100%) of the inner layers that comprise one or more sheets. In certain embodiments the outer layer is one continuous sheet configured to enclose most (e.g., greater than 95%, e.g., 100%) of the inner layers. In certain embodiments the outer layer is two or more sheets configured to enclose most (e.g., greater than 95%, e.g., 100%) of the inner layers and serve as the exterior. In particular embodiments, the inner layers are stitched to be enclosed within the outer layer. In particular embodiments, the small percentage of inner layer exteriorly exposed is covered/enclosed by a binding strip, or the like.

In certain embodiments of the invention, the outer fabric layer is created/knitted on any diameter circular or flat knitting machine of any sort (i.e. single jersey, rib, tricot etc.) and any patterning setups, cam combination, number of needle tracks, number of feeders, yarn tension controls, as well as Jacquard patterning of any kind at any Gage (needle density). In a particular embodiment, the outer fabric layer is knitted on 30" diameter machine at 28 Gage single jersey, 2640 or 2660 needles with dedicated adjustable spandex feeders.

In certain embodiments of the invention, the outer fabric layer is single jersey fabric, e.g., single jersey circular knitted fabric. Single jersey fabric may be identified by having whales in the direction of the knitting of the fabric on the technical face versus floating waves going sideways connecting the whales on the face side, for example as in FIG. 1.

Figure 2:
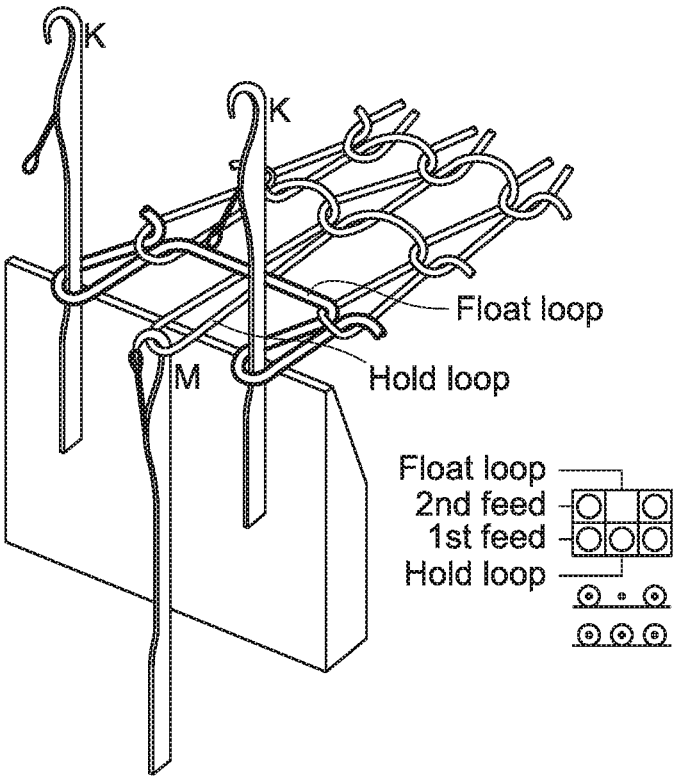
FIG. 2 provides a schematic image of a non-limiting example of a simple pattern formation of single jersey fabric made on a circular knitting machine with a single needle cylinder and cams that drive the needles into knitting positions in grooves built into the cylinder.

In one embodiment, the single jersey may be made on a circular knitting machine with a single needle cylinder and cams that drive the needles into knitting positions in grooves built into the cylinder: a non-limiting example of a simple pattern formation of the fabric is depicted in FIG. 2.

In certain embodiments of the invention, the outer fabric layer is circular knitted fabric, e.g., single jersey circular knitted fabric. For example, yarns that comprise the outer fabric layer can be of any kind of knitting yarns from any material of any thickness in any combinations, mixtures and ratios. In certain embodiments, the first material comprises cotton, e.g., fine grade combed cotton (e.g., 30 Nec (English count) fine grade combed cotton) and spandex (e.g., 70 Denier (78 DTex) spandex, e.g., Lycra® by DuPont). The yarn mix and materials mix can be of any possible kind and ratios, e.g., 94% Cotton and 6% spandex, e.g., Lycra® spandex. In an alternative embodiment, the yarn mix and materials mix can be, for example, 88.5% Cotton and 11.5% Lycra® Spandex (about 89% cotton/11% spandex).

In an alternative embodiment of the invention, the outer fabric layer is produced on a 24 Gage machine, e.g., using 24 Nec Cotton Yarn count and 70 Denier Lycra at 91.5%18.5% ratio, respectively.

The yarn consumption can be set to any possible setting that the mentioned machines will allow. In certain embodiments, the cotton eye length is 2.7 mm and the spandex eye length is 0.88 mm. Consumption may be calculated based on number of needles in the machine as mentioned above and as multiplication of the number of needles by the eye length, and measured as meters per turn.

In certain embodiments of the invention, the outer fabric layer is non-circular knitted fabric. For example, yarns that comprise the outer fabric layer can be of any kind of knitting yarns from any synthetic material suitable for constructing a stretchy fabric material, e.g., one or more synthetic fibers, of any thickness in any combinations, mixtures and ratios. In certain embodiments, the outer fabric layer comprises 150 Denier Polyester and 70 Denier (78 DTex) spandex e.g., Lycra® by DuPont. The yarn mix and materials mix can be of any possible kind and ratios, e.g., 94% Cotton and 6% spandex, e.g., Lycra® spandex. In an alternative embodiment, the yarn mix and materials mix can be, for example, 92% Polyester and 8% Lycra Spandex.

Figure 3:
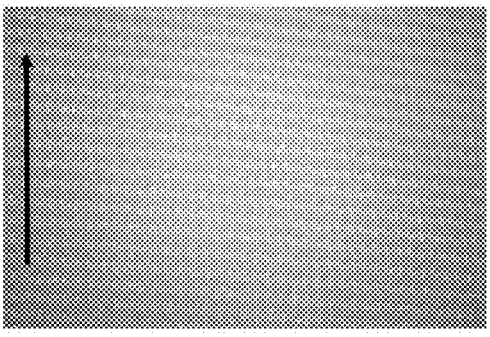
FIG. 3 provides two photographic images that depict the technical face and technical back of the tricot configuration of tricot fabric that are identified by having whales in the direction of the knitting of the fabric on the Technical Face versus whales going sideways on the Technical Back.
Figure 3:
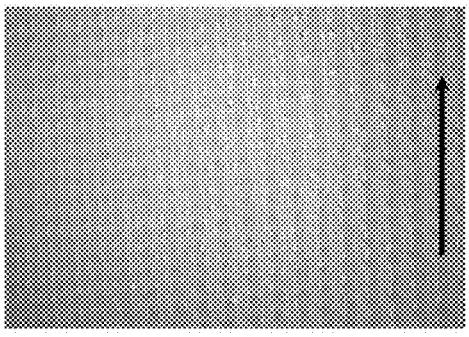

In certain embodiments of the invention, the outer fabric layer is Tricot fabric, e.g., in any Tricot configuration, e.g., Satin Tricot, which is identified by having whales in the direction of the knitting of the fabric on the Technical Face versus whales going sideways on the Technical Back. The difference in configuration may be seen in FIG. 3.

In certain embodiments of the invention, the outer fabric layer is created/knitted on either a Tricot or a Raschel knitting machine of any kind and any possible configuration, Gage, width, number of needle bars, number of guide bars, number of beams (directly driven or separately). In a particular embodiment, the outer fabric layer is knitted on a classic Tricot machine at 28 Gage (number needles per inch) with Satin Tricot settings.

In certain embodiments of the invention, the outer fabric layer is shaped into pre-defined form by stitching.

In certain embodiments of the invention, the outer fabric layer comprises a zipper.

In certain embodiments of the invention, the outer fabric layer is machine washable In certain embodiments of the invention, the outer fabric layer comes in 14 colors. For example, the outer fabric layer may be selected from a range of colors, e.g., cream, pink, red, burgundy, orange, yellow caramel, Celtic green, green, turquoise, blue, bright purple, purple, black, dark gray, light gray, or brown.

The outer fabric layer may be dyed by any available appropriate dyestuff, for example, disperse dye stuff for synthetic fibers or reactive dyestuff for cotton containing fibers, in any formulas and combinations and any possible processes and to any color on any dyeing or printing equipment, e.g., provided that such dye stuff does not significantly affect the quality of the outer fabric layer. In certain embodiments, finishing of the cotton containing outer fabric layer by treatment to functionalize the outer fabric layer may comprise one or more chemical treatments, such as an antimicrobial agent, an anti-molding agent, an anti-static charge agent, a mosquito repellant, Scotch Guard, a softener, and a UV resistance agent. In certain embodiments, finishing of the synthetic fiber outer fabric layer by treatment to functionalize the outer fabric layer may comprise one or more chemical treatments, such as a flame retardant, an antimicrobial agent, an anti-molding agent, an anti-static charge agent, a mosquito repellant, Scotch Guard, a softener, and a UV resistance agent. In certain embodiments, gentle methods are utilized. In certain embodiments, the dyeing process does not involve jet dyeing machines.

In certain embodiments of the invention, polyester outer layers may be comprised of fibers extruded with natural or synthetic inorganic pigments, e.g., to enhance UV resistance.

In certain embodiments of the invention, the spandex incorporated into the fabrics is UV and chlorine resistant, e.g., Sonora ® by DuPont.

In the preparation of the outer fabric layer, the step of fabric fixation and sizing may be performed, e.g., at any stage in the process of dyeing and finishing and should not exceed 300 degrees Fahrenheit. In certain embodiments, the step of fabric fixation and sizing is performed after scouring and before dyeing.

Fabric fixation and sizing may be under any possible conditions of stretch and tension, timing, duration, and width settings; however, the heat level should not exceed 300 degrees Fahrenheit.

Width sizing settings will depend on the original machine size. In certain embodiments, fabric width of the outer fabric layer is sized to the width of 160 cm for 45 seconds at 190 degrees Celsius. In particular embodiments, the outer fabric layer is finished with hydrophobic silicon for water and oil repellency.

In certain embodiments of the invention, the outer fabric layer weight prior to dyeing or finishing (cut and weighed directly from the knotting machine) will be about 260 GSM (Gram per Square Meter).

In certain embodiments of the invention, the final outer fabric layer weight is between 180 GSM and 300 GSM (Gram per Square Meter) measured on relaxed fabric per industry standard.

The yarn consumption can be set to any possible setting that the mentioned machines will allow. In certain embodiments, the cotton eye length is 2.7 mm and the spandex eye length is 0.88 mm. Consumption may be calculated based on number of needles in the machine as mentioned above and as multiplication of the number of needles by the eye length, and measured as meters per turn.

In certain embodiments, the outer fabric layer may be laminated with any suitable lamination materials, e.g., PU (Polyurethane) or TPU (Thermoplastic Polyurethane) film and/or liquid of any formula similar to Argotec TX1540 products with similar properties (see Table 1 below).

TABLE 1

TPU Film properties

| Physical Property | ASTM Test Method | Units | Test Value |
|---|---|---|---|
| Specific gravity | D-792 | g/cc | 1.22 |
| Shore hardness | D-2240 | Shore | 80 A |
| Tensile strength | D-412 | psi | 4000-5000 |
| | | MPa | 27.6-34.5 |
| Elongation | | % | 600-700 |
| Modulus (100%) | | psi | 550-650 |
| | | MPa | 3.8-4.5 |
| Tensile set @ 200% elongation | | % | >40 |
| Tear (die C) | D-1004 | Graves g/0.001" | 120-140 |
| Moisture vapor transmission | E-96 procedure B upright* | $g/m^2/24$ hr | |
| 0.5 mil (12 μ) | | | — |
| 0.6 mil (15 μ) | | | 800-900 |
| 1.0 mil (25 μ) | | | 700-800 |

The lamination may be applied by heat and/or by adhesives of any kind, e.g., bonded by heat, or water-based or solvent-based adhesives, e.g., polyurethane adhesives consisting of a high molecular weight hydroxyl terminated polyurethane dissolved in a solvent, with or without isocyanates such as toluene diisocyanate (TDI) and diphenylmethane isocyanate (MDI) to avoid discoloration and deterioration of mechanical properties of the adhesive and/or combine antioxidant and UV absorbers for stabilization.

The laminated film may be any thickness, e.g., 1-1.5 mils.

In certain embodiments of the invention, the outer fabric layer is laminated with a Polyurethane or Thermoplastic Polyurethane film.

In certain embodiments of the invention, the thickness of laminated film is 1-1.5 mils.

In certain embodiments of the invention, the laminated material is treated to functionalize the material. In certain embodiments, the laminated material is treated to functionalize the material with an agent selected from one or more of the group consisting of a flame retardant, an antimicrobial agent, an anti-molding agent, an anti-static charge agent, a mosquito repellant, Scotch Guard, a softener, and a UV resistance agent. In particular embodiments, the laminated material is treated to functionalize the material with a flame retardant, e.g., Pyrovatex SVC®.

B. Inner Fabric Layer

The QSF of the present invention comprise a stretch-resistant inner layer, e.g., engineered to be stretch-resistant (e.g., comprising one or more fibers). The one or more stretch-resistant inner layer(s) define the inner structure of the QSF (i.e., the internal layer adding structural stability support) and is mostly enclosed (e.g., greater than 95%, e.g., 100%) by the outer layer.

In certain embodiments of the invention, the stretch-resistant fabric material is woven fabric.

In certain embodiments of the invention, the stretch-resistant fabric material is silk, e.g., pure silk.

In certain embodiments of the invention, the stretch-resistant fabric material is artificial silk.

In certain embodiments of the invention, the stretch-resistant fabric material comprises 100% polyester or blends thereof in any ratios.

In certain embodiments of the invention, the stretch-resistant fabric material comprises rayon or blends thereof in any ratios.

In certain embodiments of the invention, the stretch-resistant fabric material comprises nylon or blends thereof in any ratios.

In certain embodiments of the invention, the stretch-resistant fabric material comprises blends of polyester and other materials such as rayon or nylon of all kind (e.g., either pure or blended), in any ratios.

In certain embodiments of the QSF of the present invention, the QSF may comprise additional inner fabric layers of stretch-resistant fabric material, e.g., further comprising a second inner fabric layer comprising a stretch-resistant fabric material.

C. Stitching

The outer and inner fabric layers of the QSF of the present invention are securely associated by stitching, e.g., with yarn or thread, to produce the QSF such that the outer and inner fabric layers remain securely associated upon strain applied to the stitching.

Stitching may be carried out using any thread that is of suitable properties and strength to join the layers of fabric material and any needle that is able to pierce all fabrics without significantly damaging the fabric, e.g., without damaging the fabric (e.g., in a commercially unreasonable manner). Any type of stitch may be used to join the layers of fabric material and the stitches may be formed by hand sewing, machine sewing or a combination thereof. Continuous stitching, such as chain stitch, lock stitch, running stitch, or stretch stitch may be used to join the layers of fabric, and any stitch length may be used, such as 6 stitches per inch or 12 stitches per inch. Discontinuous stitching, e.g., tying, may also be used to join the layers of fabric material; short, single lengths of thread are passed through all layers of fabric material and the ends of the length of thread are securely tied together on the same side.

In certain embodiments of the invention, the stitching is non-stretch stitching, e.g., lock stitch stitching.

In certain embodiments of the QSF of the present invention, the layers are positionally matched and securely associated by stitching along the entire length of all edges.

In certain embodiments, the layers are further securely associated by a suitable quilting pattern, e.g., wherein the suitable quilting pattern is stitched in partial or full parallel alignment with the crosswise or lengthwise grain of the stretch-resistant fabric. In specific embodiments, the suitable quilting pattern is stitched in full parallel alignment with the crosswise and lengthwise grain of the stretch-resistant fabric.

In certain embodiments, the suitable quilting pattern is selected based on the type of batting material positioned in any core layer present in the QSF, e.g., to ensure that the core layer is securely associated with the inner and outer layers. In certain embodiments, the stitches of the suitable quilting pattern are less than 12 inches apart, e.g., less than 11 inches apart, e.g., less than 10 inches apart, e.g., less than 9 inches apart, e.g., less than 8 inches apart, e.g., less than 7 inches apart, e.g., less than 6 inches apart, e.g., less than 5 inches apart. In certain embodiments, the stitches of the suitable quilting pattern are 10 inches apart.

In certain embodiments, the stitching may be continuous. In certain embodiments, the stitching may not be continuous, for example, the quilting may involve the process of tying that is, instead of stitching in patterns, extra sturdy thread is stitched through all the layers in one spot, and brought back through all the layers in the same spot (e.g., with repetition) and the ends are tied. Moreover, the stitching throughout the middle of the blanket may be in any pattern. For example, it can be straight, curved, cross on itself or another seam, or never cross on itself or another seam, etc.

In certain embodiments the stitching thread is spun polyester, e.g., 60/3 Nec spun polyester.

In certain embodiments the stitching needle is round tip, e.g., round tip #11.

In certain embodiments the machine foot used for stitching is Teflon coated.

In certain embodiments the machine used for stitching is equipped with walking foot.

D. Central Core Layer

In certain embodiments of the QSF of the present invention, the QSF may comprise additional inner fabric layers of stretch-resistant fabric material, e.g., further comprising a second inner fabric layer comprising a stretch-resistant fabric material. In certain embodiments of the QSF of the present invention comprising additional fabric layers, the QSF may further comprise a central core material layer positioned between two inner fabric layers, e.g., between the first and second inner fabric layers. In addition, in another example, the QSF may comprise three inner fabric layers, affording the QSF the potential for two separate central core layers positioned between the central inner fabric layer and each of the bookend inner fabric layers, e.g. inner fabric layers above and below the central inner fabric layer (e.g., all of which is enclosed within the outer fabric layer).

In certain embodiments of the invention, the central core material is selected to glide freely against the stretch-resistant fabric material (e.g., to provide a comfortable tactile feel to the QSF by a user). In particular embodiments, the central core material is batting, down, synthetic down or any combination thereof, e.g., at any ratio and any density and fineness. In a specific embodiment, the central core material is natural fiber batting. In another specific embodiment, the central core material is synthetic fiber batting.

In certain embodiments of the invention, the stretchy fabric material, the stretch-resistant fabric material, and the central core material layer are essentially the same shape and size.

In certain embodiments of the invention, the stretchy fabric material, the stretch-resistant fabric material, and the central core material layer weight ratio is 180/35/110 GSM (Gram per Square Meter) respectively.

E. Additional Components

In certain embodiments of the QSF of the present invention, the QSF further comprises a fabric binding strip securely associated with and enclosing the edges of all layers of the QSF by stitching along the entire length of all edges. In particular embodiments, this binding strip may be used to completely enclose any exteriorly exposed inner layers.

In certain embodiments, the fabric binding strip material may be selected from the materials described herein for the outer fabric layer. In particular embodiments, the fabric binding strip is the same material as the outer fabric layer. In certain embodiments, the fabric binding strip material is circular knitted fabric, e.g., single jersey, e.g., tricot fabric. In particular embodiments, the fabric binding strip material comprises a yarn mix ratio of 94% cotton yarn and 6% spandex yarn.

In certain embodiments, the fabric binding strip material is stretch-resistant fabric material. In particular embodiments, the fabric binding strip material is selected from the materials of described herein for the inner fabric layer. For example, the fabric binding strip may be the same stretch-resistant fabric material as the inner stretch-resistant fabric material.

In certain embodiments of the invention, the fabric binding strip material is treated to functionalize the material. In particular embodiments, the fabric binding strip material is treated to functionalize the material with an agent selected from one or more of the group consisting of a flame retardant, an antimicrobial agent, an anti-molding agent, an anti-static charge agent, a mosquito repellant, Scotch Guard, a softener, and a UV resistance agent. In a specific embodiment, the fabric binding strip material is treated to functionalize the material with a flame retardant, e.g., Pyrovatex SVC®.

III. Method of Preparation of Structurally Stable Quilted Stretchable Fabric of the Invention In another embodiment, the present invention provides a method of preparing a structurally stable quilted stretchable fabric (QSF) of the present invention comprising:

securely associating an outer fabric layer comprising a stretchy fabric material and an inner fabric layer comprising a stretch-resistant fabric material by stitching, e.g., through all layers along the entire length of all edges, to produce the structurally stable, quilted stretchable fabric (QSF), wherein the outer and inner fabric layers remain securely associated upon strain applied to the stitching.

In certain embodiments, the outer and inner fabrics are essentially the same shape and size. In particular embodiments, the method further comprises the step of aligning and positionally matching the outer and inner layers.

In certain embodiments, the method further comprises selecting the stretch-resistant fabric material to glide freely against the stretchy fabric material.

In certain embodiments, the method further comprises selecting a suitable quilting pattern parallel to the lengthwise and crosswise grains of the stretch-resistant fabric.

In certain embodiments, the QSF further comprises a second inner fabric layer comprising a stretch-resistant fabric material, the method further comprises adding a central core batting material layer positioned between the first and second inner fabric layers.

In certain embodiments, the method further comprises adding a fabric binding strip securely associated with and enclosing the edges of all layers of the QSF by stitching along the entire length of all edges.

In certain embodiments, the method further comprises selecting a sewing thread and a sewing needle suitable for sewing together the outer and inner layers of fabrics.

In certain embodiments, the method further comprises obtaining the outer layer, the inner layer, and the material for stitching, e.g., thread.

In certain embodiments of the invention, the step of obtaining the outer fabric layer comprises preparing the outer fabric layer. In particular embodiments, the step of preparing the outer fabric layer comprises one or more of the following processes, e.g., as described herein: knitting, scouring, fixation, sizing, dyeing, and/or finishing. In certain embodiments, finishing may include printing, coating, fire retardant treatment, antimicrobial treatment, anti mold treatment, Scotch Guard treatment, brushing, sanding, packaging in rolling, or lagging.

EXEMPLIFICATION

Having thus described the invention in general terms, reference will now be made to the accompanying drawings of exemplary embodiments, which are not necessarily drawn to scale, and which are not intended to be limiting in any way.

In this respect, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Example 1

Blanket Comprising a Structurally Stable Quilted Stretchable Fabric (QSF)

Figure 4:
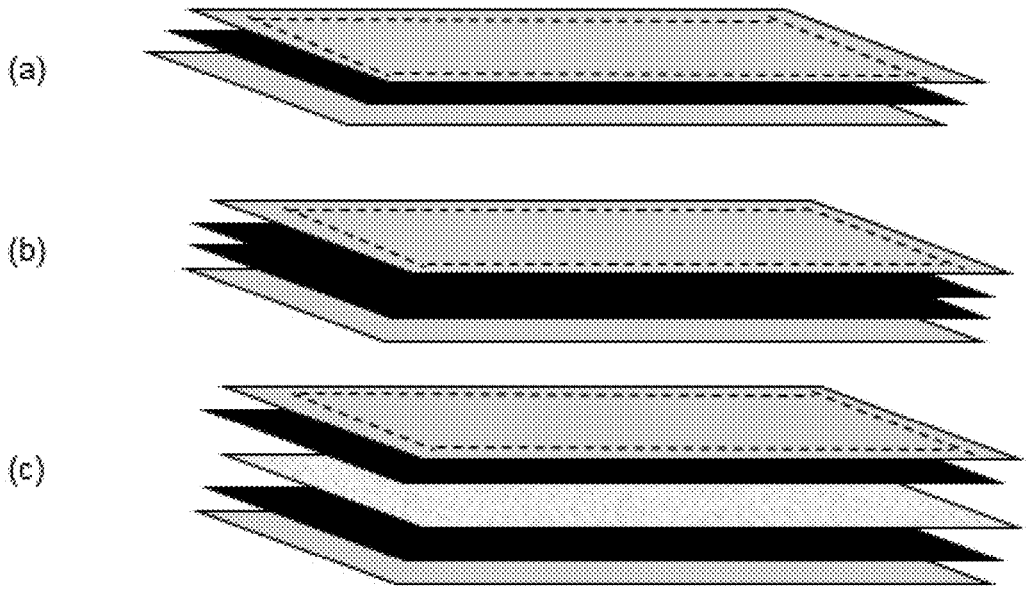
FIG. 4 depicts multiple side perspectives of certain particular embodiments of the present invention related to a blanket comprising a structurally stable quilted stretchable fabric (QSF) of the present invention. Section (a) comprises one inner layer, represented as the black layer; Section (b) comprises two inner layers represented as the black layers; Section (c) comprises two inner layers represented as the black layers that sandwich a central core layer.

FIG. 4 depicts multiple side perspectives of certain particular embodiments of the present invention related to a blanket comprising a structurally stable quilted stretchable fabric (QSF) of the present invention. In particular, the outer fabric layer showing as two separate sheets, represented by the lightly shaded color, is a stretchy fabric material, e.g., a circular knitted fabric, e.g., comprising a yarn mix ratio of 94% cotton yarn and 6% spandex yarn. The QSF embodiment shown in section (a) comprises one inner layer, e.g., a stretch-resistant artificial silk, represented as the black layer. The QSF embodiment shown in section (b) comprises two inner layers represented as the black layers. The QSF embodiment shown in section (c) comprises two inner layers represented as the black layers that sandwich a central core layer in gray/white, e.g., of batting, e.g., synthetic fiber batting. In each embodiment, the layers are essentially the same shape and size, and are securely associated by stitching along the entire length of all edges. The dashed lines represent stitching, e.g., non-stretch stitching, though all layers of material.

Figure 5:
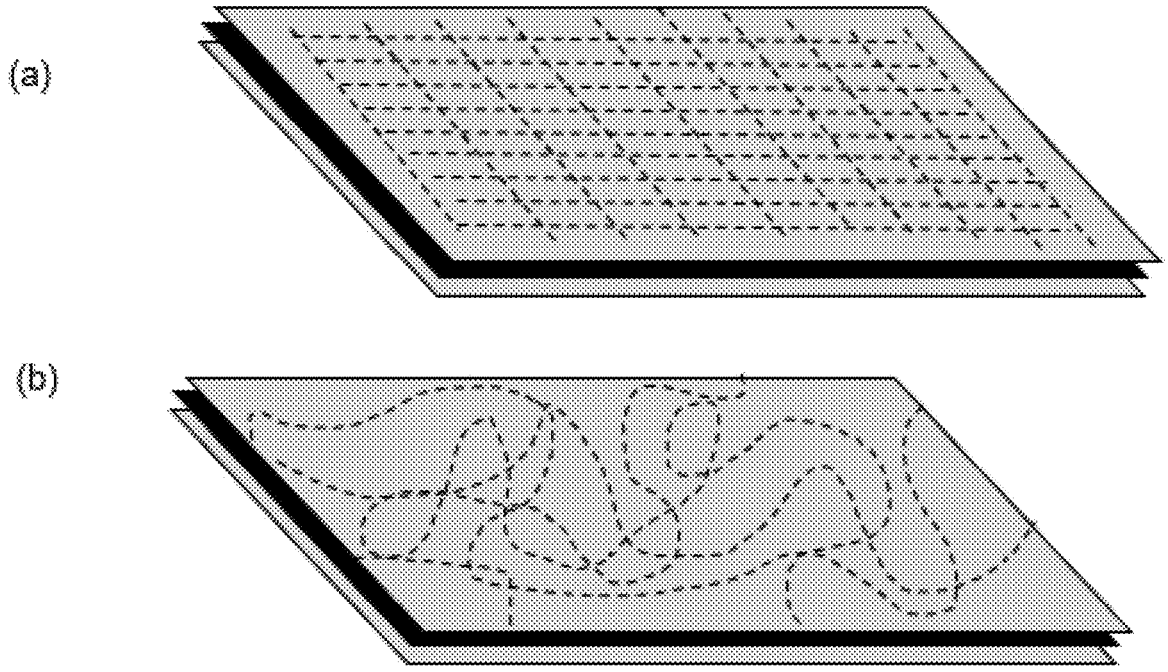
FIG. 5 depicts multiple side perspectives of certain particular embodiments of the present invention related to a blanket comprising a structurally stable quilted stretchable fabric (QSF) of the present invention comprising suitable quilting patterns. Section (a) comprises one inner layer represented as the black layer and a suitable grid-shaped quilting pattern. Section (b) comprises one inner layer represented as the black layer and a suitable quilting pattern without regular pattern.

FIG. 5 depicts multiple side perspectives of certain particular embodiments of the present invention related to a blanket comprising a structurally stable quilted stretchable fabric (QSF) of the present invention comprising suitable quilting patterns. In particular, the outer fabric layer showing as two separate sheets, represented by the lightly shaded color, is a stretchy fabric material, e.g., a circular knitted fabric, e.g., comprising a yarn mix ratio of 94% cotton yarn and 6% spandex yarn. The QSF embodiment shown in section (a) comprises one inner layer, e.g., a stretch-resistant artificial silk, represented as the black layer and a suitable grid-shaped quilting pattern (e.g., 10 inches apart). The QSF embodiment shown in section (b) comprises one inner layer, e.g., a stretch-resistant artificial silk, represented as the black layer and a suitable quilting pattern without regular pattern. The dashed lines represent stitching, e.g., non-stretch stitching, though all layers of material.

In certain embodiments, a binding strip comprising the stretchy circular knitted fabric of the outer fabric layer might be used to bind the entire length of the edges. For example, in a blanket construction, the edges are most likely covered with a fabric binding strip.

INCORPORATION BY REFERENCE

The entire contents of all patents, published patent applications and other references cited herein are hereby expressly incorporated herein in their entireties by reference.

EQUIVALENTS

Those skilled in the art will recognize, or be able to ascertain using no more than routine experimentation, numerous equivalents to the specific embodiments/procedures described herein. Such equivalents are considered to be within the scope of this invention and are covered by the following claims. Moreover, any numerical or alphabetical ranges provided herein are intended to include both the upper and lower value of those ranges. In addition, any listing or grouping is intended, at least in one embodiment, to represent a shorthand or convenient manner of listing independent embodiments; as such, each member of the list should be considered a separate embodiment.

What is claimed is:

1. A structurally stable quilted stretchable fabric (QSF) comprising:

an outer fabric layer comprising a stretchy fabric material with a first surface outwardly disposed on a first side of the outer fabric layer and a second surface outwardly disposed on a second side of the outer fabric layer opposite the first surface; and an inner fabric layer comprising one or more sheets of a stretch-resistant fabric material that is greater than 95% surrounded by the stretchy fabric material of the outer layer, comprising a third surface outwardly disposed on a first side of the inner fabric layer and a fourth side outwardly disposed on a second side of the inner fabric layer opposite the third surface, wherein the outer fabric layer is present on the exterior of the QSF and is (1) one continuous sheet configured to surround greater than 95% of the inner fabric layer or (2) the outer fabric layer is two or more sheets configured to surround greater than 95% of the inner fabric layer, wherein the outer and inner fabric layers are securely associated by stitching to produce the QSF, and wherein the outer and inner fabric layers remain securely associated upon strain applied to the stitching, and wherein:

(a) when the outer fabric layer is one continuous sheet, a first side of the continuous sheet forms both the first and second surfaces outwardly disposed on the first and second side of the outer fabric layer, and the second side of the continuous sheet makes contact with each of the third and fourth surfaces of the inner fabric layer; or (b) when the outer fabric layer is two or more sheets, a third side of a first sheet of the outer fabric layer and a fourth side of a second sheet of the outer fabric layer form both the first and second surfaces outwardly disposed on the first and second side of the outer fabric layer, and the opposite sides of the first and second sheets make contact with each of the third and fourth surfaces of the inner fabric layer.

2. The quilted stretchable fabric (QSF) of claim 1, wherein the stretch-resistant fabric material is selected to glide freely against the stretchy fabric material.

3. The quilted stretchable fabric (QSF) of claim 1, wherein the inner and outer fabric layers are securely associated by stitching thread.

4. The quilted stretchable fabric (QSF) of claim 1, wherein the strain is repeated strain.

5. The quilted stretchable fabric (QSF) of claim 1, wherein the stitching is straight stitch stitching.

6. The quilted stretchable fabric (QSF) of claim 1, wherein the stitching is non-stretch stitching.

7. The quilted stretchable fabric (QSF) of claim 1, wherein the stretchy fabric material is circular knitted fabric.

8. The quilted stretchable fabric (QSF) of claim 7, wherein the stretchy fabric material is single jersey fabric.

9. The quilted stretchable fabric (QSF) of claim 1, wherein the stretch-resistant fabric material is woven fabric.

10. The quilted stretchable fabric (QSF) of claim 1, wherein the inner fabric layer comprises two sheets of the stretch-resistant fabric material.

11. The quilted stretchable fabric (QSF) of claim 10, further comprising a central core material layer positioned between the two sheets of the inner fabric layer.

12. The quilted stretchable fabric (QSF) of claim 11, wherein the central core material is selected to glide freely against the stretch-resistant fabric material.

13. The quilted stretchable fabric (QSF) of claim 12, wherein the central core material is batting, down, synthetic down or any combination thereof.

14. The quilted stretchable fabric (QSF) of claim 1 further comprising a fabric binding strip securely associated with and enclosing the edges of all layers of the QSF by stitching along the entire length of all edges.

15. The quilted stretchable fabric (QSF) of claim 14, wherein the fabric binding strip material is circular knitted fabric.

16. An article of manufacture comprising a structurally stable quilted stretchable fabric (QSF) of claim 1.

17. The article of manufacture of claim 16 selected from the group consisting of a blanket, a toy, a pillow, a pillow cover, a furniture cover, an article of clothing, a sleeping bag, and a fabric.

18. A method of preparing a structurally stable quilted stretchable fabric (QSF) of claim 1 comprising:

securely associating an outer fabric layer comprising a stretchy fabric material and an inner fabric layer comprising a stretch-resistant fabric material by stitching, to produce the structurally stable, quilted stretchable fabric (QSF), wherein the outer and inner fabric layers remain securely associated upon strain applied to the stitching.

19. The method of claim 18, wherein the outer and inner fabric layers are essentially the same shape and size.

20. The method of claim 19, further comprising the step of aligning and positionally matching the outer and inner layers.

21. The method of claim 18, further comprising selecting the stretch-resistant fabric material to glide freely against the stretchy fabric material.

22. The method of claim 18, further comprising selecting a suitable quilting pattern parallel to the lengthwise and crosswise grains of the stretch-resistant fabric.

23. The method of claim 18, wherein the inner fabric layer comprises two sheets of the stretch-resistant fabric material, and further adding a central core batting material layer positioned between the two sheets of the inner fabric layer.

24. The method of claim 18, further adding a fabric binding strip securely associated with and enclosing the edges of all layers of the QSF by stitching along the entire length of all edges.

* * * * *